United States Patent [19]

Gerry

[11] 4,191,911

[45] Mar. 4, 1980

[54] AC POWER GENERATION CONTROL SYSTEM

[76] Inventor: Martin E. Gerry, 13452 Winthrope St., Santa Ana, Calif. 92705

[21] Appl. No.: 963,525

[22] Filed: Nov. 24, 1978

[51] Int. Cl.[2] ..... F02P 9/00

[52] U.S. Cl. ..... 315/209 R; 315/156; 361/256; 361/156; 315/209 T; 123/148 E

[58] Field of Search ..... 123/148 E, 148 B; 361/256, 156; 315/156, 209 R, 209 T, 209 CD, 209 M

[56] References Cited

U.S. PATENT DOCUMENTS

| | | | |
|---|---|---|---|
| 4,122,815 | 10/1978 | Gerry | 123/148 E |
| 4,140,946 | 2/1979 | Gerry | 315/209 R |
| 4,144,476 | 3/1979 | Gerry | 315/209 R |

*Primary Examiner*—Alfred E. Smith
*Assistant Examiner*—Charles F. Roberts

[57] ABSTRACT

An alternating current power source which is generally used to feed an ignition transformer primary winding may be electronically controlled so as to rapidly activate and deactivate the power source for each ignition cycle. An electronic switch intermittently interrupts current flowing in the primary winding and in the output circuit of the power source. Such electronic switch is made operable by virtue of the peak excursions of the alternating current, thus supplying the necessary collector potential to such switch during each firing cycle of the system. Such control system can have these type of controls in the collector circuit of the power source, the emitter circuit of such power source, the DC power input circuit for such power source, or in the output circuit of the power source's output transformer. A capacitor in series with the output circuit of the power source and with the primary winding enables current to be transferred out of the power source to such primary winding. Such electronic switch will provide discrete separation between successive output waveforms of successive ignition firing cycles. The system has appropriate logic circuits which initiate current conduction through the electronic switch and in the oscillator stages of the power source for each firing cycle, turning off the switch and oscillator stages between firing periods. Various types of trigger timing circuits are usable to trigger the several logic circuits for initiating igniter firing by means of the resultant high voltage and high current in the secondary winding of the ignition transformer.

17 Claims, 7 Drawing Figures

AC POWER GENERATION CONTROL SYSTEM

INCORPORATION BY REFERENCE

U.S. Pat. No. 4,122,815 issued Oct. 31, 1978 to same applicant, is incorporated by reference herein as though fully set forth, for the timing method disclosed therein.

BACKGROUND OF THE INVENTION

This invention is in the field of alternating current power sources as used in ignition systems for fuel burning engines.

Prior art systems generally do not involve keying of the AC power source but feed the AC power directly to their igniter circuits. Failure to key such power source results in a low energy level being fed to an igniter by virtue of failure to generate transient currents, highly desireable in such systems.

Should the problem of low energy level ever be resolved, such prior art systems will still fail to perform satisfactorily when AC powered since at higher power and energy levels, the waveforms of voltage and current during firing cycles when not accurately controlled result in successive firing cycle waveforms without any discontinuities therebetween, resulting in pre-ignition of fuel in the engine.

SUMMARY OF THE INVENTION

It is therefore an objective of this invention to provide a high power AC source which is automatically turned off between firing cycles, wherein the energy output of such source is substantially greater than any such source as used in ignition systems.

It is also an objective of this invention to provide means for delivering higher current from the AC power source to an ignition transformer primary winding and consequently delivering higher ignition energy levels.

It is a further objective of this invention to provide switching means of the electronic or other like type which is automatically triggered by a logic circuit, so that energy residual in various parts of the AC power source circuit will be inhibited or not be transferred to the ignition transformer when the AC power source is keyed to its off mode between ignition firing cycles, so that discrete discontinuities between voltage and current waveforms will prevail, and thus ignition timing could be aptly controlled to avoid pre-ignition firing in the engine firing chambers.

Accordingly, a control system is provided for the AC power source with a choice of any of a plural number of electronic switches in various parts of such AC power source circuit to effect such control.

The load fed by the AC power source consists of a transformer having a primary winding coupled to output means of the AC power source. Switching means in the primary circuit is utilized so that when the power source is biased by means of a logic circuit to a quiescent state, the switching means acts to inhibit residual energy in the output means of the AC transformer of the power source from being transferred to the primary winding of the ignition transformer. Such electronic switch is enabled by virtue of the alternating current providing the requisite positive peaks imposed upon the collector of the switch to enable such switch to conduct without the need of the usual DC power feeding such collector. Such switching means may be an electronic switch, generally of the high power and high voltage transistor category. Additionally or alternatively, an electronic switch may be connected between the DC power source used to power the AC source and such AC source, or such switch may be in series with the output means of such AC source. Also, such electronic switch may be in the collector or emitter circuits of the AC source, any of such locations for such switch serving to rapidly cut off energy feed to the load on completion of the ignition cycle, which energy may be residual in the output transformer of the AC power source.

A capacitor utilized in the primary circuit enables power to be transferred to such circuit from the AC power source.

The oscillator stages of the AC power source or any of the electronic switches may utilize Darlington type transistor circuits.

Logic means, coupled to the AC power source and to the switching means, provides substantially simultaneously, bias to the AC power source and to the switching means for turning on the AC power source as well as causing conduction in the switching means.

Various trigger circuits are provided to initiate the logic means, such as a magnetic pulse timer, a cam actuated pair of contactors, an electrically conductive disk with insulative members and a contactor, an optical timer, or a modulated oscillator, any one of which may be coupled to the logic means.

DETAILED DESCRIPTION

Figure 1:
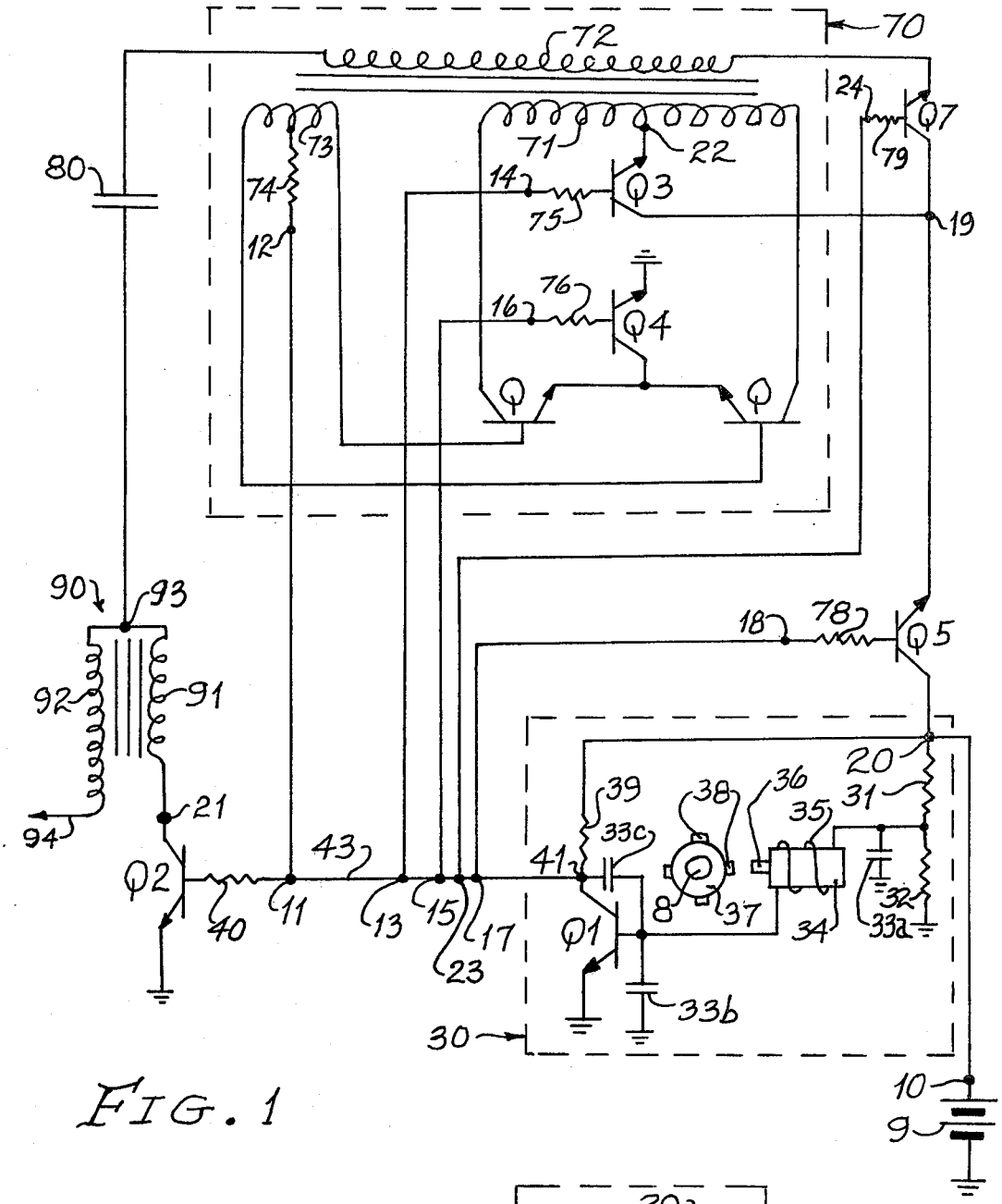
FIG. 1 is a schematic of the control system for the AC power source as well as the AC power source itself, showing the logic circuit and utilizing magnetic pulse triggering, according to the invention.

Referring to FIG. 1, a high voltage, high current and consequently a high energy AC power source 70 provides alternating current output through its output means 72, which is the secondary winding of a coupling transformer used in source 70. Such source 70 is generally used to power an automotive or like ignition system. This system features an energy inhibit switch electronically controlled by a logic circuit, wherein the inhibit switch may be optionally located in about five different locations in the system. The logic circuit substantially simultaneously turns on the alternating current source and the inhibit switch during the operative period of each firing cycle of the system and turns off the alternating current power source and energy inhibit switch during the non-firing portions or quiescent periods of the system. In FIG. 1, such logic circuit is triggered by a magnetic pulse timer.

In this specification, the conventional ground symbol is shown signifying either negative battery potential of battery 9, DC electrical return paths or AC electrical return paths, and hence such return paths and negative battery potential need not be referred to hereinbelow in explaining the operation of the system.

Accordingly, battery 9, generally of the 12 volt type, provides DC power to the system to make available such DC power at junction 10, and to feed DC power directly to logic circuit 30 and to alternating current power source 70.

Alternating current power source 70 is shown as a transistor type rectangular waveform generator, but it is to be understood that any alternating current source providing for example a saw tooth waveform, a triangular waveform or a sinusoidal waveform may be effectively used to effect this invention, in the circuits of FIG. 1 or in the circuits shown in other figures of this specification.

The magnetic pulse timer, conventional to the automotive field, consists of reluctance wheel 37 having regularly spaced ribs 38 at the wheel periphery, wherein wheel 37 and its ribs 38 are made of a suitable magnetic material and wherein such wheel is driven by distributor shaft 8 which is common to any automotive engine. Such timer employs permanent magnet 34 having a sensor winding 35 thereon. Magnet 34 has pole piece 36 at one end, so that when shaft 8 is driven by the engine, ribs 38 will interrupt magnetic flux lines between ribs 38 and pole piece 36, and induce a voltage in winding 35.

The magnetic timer may be designed with respect to the orientation of the north and south magnetic poles of magnet 34 as well as with respect to the direction of the turns of wire comprising winding 35, so as to provide either a leading negative or leading positive going pulse as an output of winding 35 when one of ribs 38 is driven past pole piece 36. The leading negative pulse design was adopted herein since this is conventional in the automotive industry, and accordingly the components of logic circuit 30 are tailored to recognize such timer pulse. The voltage output in the form of such pulse is fed to logic circuit 30.

Logic circuit 30 comprises a voltage divider consisting of resistors 31 and 32 having a capacitor **33*a* shunting resistor 32. Such voltage divider is connected to DC power at 10, and resistors 31 and 32 are chosen so that a positive DC potential of about 1.2 volts appears at the junction between resistors 31 and 32 to which one end of winding 35 is connected. Such logic circuit herein utilizes an NPN type transistor switch Q1, the collector of which is connected through resistor 39 to junction 10 so as to provide DC power to switch Q1. The other side of winding 35 is connected to the base of Q1, and such base has capacitor 33*b* connected between it and ground or the emitter of Q1, which emitter is at ground potential. The function of capacitors 33*a* and 33*b* is to filter out and reject AC components riding on the gate pulse appearing between terminal 41 and ground, and initiated by winding 35 due to switching action of the timer when shaft 8 drives reluctor wheel 37. If desired, an additional capacitor 33*c* may be connected between the base of Q1 and terminal 41 for effecting additional rejection of such timer generated AC components. However, in this system, it may be an advantage to pass such timer generated AC components as they serve to modulate the gate or firing pulse, thereby adding more firing energy by increasing the alternating current output of source 70 by virtue of adding such components to the firing current in transformer 90. In such latter instance, capacitors 33*b* and 33*c* may be omitted. Such added components are injected by virtue of switches Q2, Q3, Q4, Q5 or Q7, whichever one of these switches are used. It should also be noted that it would be a simple matter to utilize a PNP type transistor as Q1 logic switch with appropriate changes in the rest of the circuit comprising logic circuit 30. Hence, junction 41 is the point in the system which will change in its potential to enable switching control of the alternating current source 70** and such of the energy inhibit switches Q2, Q3, Q4, Q5 or Q7 as may be used.

Operatively, when shaft 8 is not being rotated or driven by the engine, no voltage is provided by winding 35 to the base of Q1. Under such condition, the base of Q1 will be at a positive potential, sufficient to maintain Q1 in its ON mode, so that junction 41 will be at ground potential. In this case, DC current will flow through winding 35 to maintain the base of Q1 at a positive potential, thereby maintaining Q1 in its ON state, in which case junction 41 is at ground potential thus causing the base of Q2 to be at ground potential as well as the bases of both Q's of source 70, thereby preventing source 70 from oscillating and Q2 from conducting.

When shaft 10 is driven, a pulse having a negative excursion is induced across winding 35 at the time when one of ribs 38 is driven past pole piece 36, providing such negative going pulse to the base of Q1 and turning off Q1, thereby causing junction point 41 to be at positive potential, and under these conditions, turning on oscillator 70 by virtue of positive DC being applied to the bases of the Q's thereof, as well as by turning on switch Q2 by virtue of such same DC positive bias being applied to its base. The manner in which Q2 obtains its collector enabling voltage will be discussed below. The following table shows the switching logic of the FIG. 1 configuration:

| Shaft 8 | Potential at Base of Q1 | State of Q1 | Potential of Junction 41 | State of Q's | State of Q2 |
|---|---|---|---|---|---|
| at standstill | positive | ON | ground | OFF | OFF |
| being driven | negative | OFF | positive | ON | ON |

Since Q1 is generally a silicon device, it requires a base potential between 0.6 to 0.8 volts to maintain it in its conductive state, and hence the +1.2 volts provided between the junction of resistors 31 and 32 and ground, even considering the voltage drop in winding 35, will still maintain adequate voltage level at Q1 base within the stated limits for minimum sustaining voltage, so that Q1 will be in the ON state when shaft 8 is at standstill as well as when shaft 8 is driven but when ribs 38 are not opposite pole piece 36. In the ON state of Q1, junction 41 will be at ground potential thereby biasing the base of Q2 and the bases of the Q's to cause them to be non-conductive, or in their OFF states.

The divider network consisting of resistors 31 and 32 is chosen so that the voltage at such resistor junction will be 1/10 th the battery voltage. Hence, if the battery or power source charging such battery is defective so that only 8 volts is provided by the battery, there will still be 0.8 volts at such resistor junction which will be sufficient to maintain switching action of Q1 and operate logic circuit 30. Additionally, the manner in which winding 35 is connected in the logic circuit and the large capacitance of capacitor 33*a*, permitted at its shown location, act to provide a stable source of input voltage to winding 35, and thereby provides a very reliable switching logic circuit.

When shaft 8 is driven and one of ribs 38 is driven past pole piece 36, a negative pulse will be induced in winding 35 which is between 1.5 and 2 volts in amplitude, thereby overcoming the positive bias of the base of Q1 and driving such base negative thereby cutting off current conduction between the collector and emitter of Q1, so that Q1 in switching to its OFF state, will cause junction 41 to be raised to a positive potential so as to turn on the Q's of power source 70 and Q2. The manner in which the Q's of source 70 turn on and off at a particular oscillating frequency or repetition rate is well known in the art and need not be discussed.

When power source 70 is turned on during each firing cycle, that is, each time one of ribs 38 is driven past pole piece 36, such source stays on for the duration when any portion of rib 38 is opposite any portion of pole piece 36, providing the firing gate or firing period at 41 to enable firing of an igniter in an engine, not shown. Power source 70 will keep on generating rectangular waves during such firing gate by virtue of Q1 being in its OFF state and consequently Q2 and the Q's being biased so as to cause Q2 to conduct during such firing gate period and the Q's to oscillate during such firing gate period. By virtue of rotation of wheel 37, when pole piece 36 is positioned between ribs 38, no firing gate is provided because there is absent the required negative going pulse as input to the base of Q1, so that Q1 is again biased sufficiently positive to switch it to its ON state thereby turning off Q2 and both Q's.

Power source 70 has as an integral part thereof a coupling output transformer the design of which controls the frequency or repetition rate of source 70. In this instance, a power source providing a 5 kilocycle rectangular repetition wave was utilized experimentally, the results of which will be discussed below. The output transformer has a center tapped primary winding 71 the ends of such winding being connected each respectively to the collectors of each of the Q's, the emitters of these Q's being at ground potential in a common emitter configuration when Q4 is not in circuit. The oscillator circuit utilizes Q's which are of the NPN type and preferably of the Darlington circuit configuration since such Darlington circuits will have inherently high current amplification characteristics which will provide high induced voltage levels in primary 71. Feedback winding 73 is also center tapped and the ends thereof are respectively connected, one to each base of transistors Q, so as to provide magnetic coupling between windings 73 and 71 and a feedback voltage to maintain oscillation of power source 70. The center tap of winding 73 has bias resistor 74 connected thereto to set the bias current to the proper level for enabling source 70 to be pulsed ON each time junction 41 and consequently terminals 11 and 12 and wire 43 are at positive potential to simultaneously provide proper bias so as to turn on switch Q2. When junction 41 is at ground potential, transistors Q2 and the Q's will be in their OFF states.

It is pointed out that NPN Darlington transistors type 2N6284 made by Motorola were used experimentally as the Q's with excellent performance resulting. It is also to be noted that PNP Darlington transistors of type 2N6287 made by Motorola give similar excellent results. However, with the PNP type transistors, circuit 70 was modified so that the collectors were at negative battery or ground potential, and the emitters were at positive DC potential, and the logic circuit had to be modified to provide the ON and OFF modes discussed above which are compatible with required potentials for the bases of the PNP transistors.

The transformer of source 70 has a secondary winding 72 which provides energy to an external load, such as capacitor 80 and primary winding 91 of transformer 90, as well as being an enabling means to initiate conduction in Q2 by providing thereto a series of positive potentials by virtue of the positive peaks of the waveform generated by circuit 70 during each firing cycle. It is to be noted that DC positive potential to the Q's is provided by virtue of center tap 22 of winding 71 being connected to junction 20, when Q3, Q7 and Q5 are not being used. It is also to be noted that winding 72 is connected to junction 20 when Q3, Q7 and Q5 are not being used. It should also be pointed out that winding 72 connected to junction 20, could have been connected to ground instead, if desired.

Capacitor 80 is coupled to winding 72 at one side, the other side of the capacitor being connected to common terminal 93 of ignition transformer 90. Here too, such other side of capacitor 80 could have been connected to terminal 21, in which case terminal 93 would have been connected to the collector of Q2.

Capacitor 80 is the means for enabling current, and hence power, to be transferred from primary circuit winding 71 through secondary 72 to the load, in this case to transformer primary 91. Without such capacitor the primary current would not be present in sufficient quantity in primary winding 91, and consequently the voltage across primary 91 would be inadequate. Considering that the circuit comprising winding 72, primary 91 and the reactance reflected by secondary 92 when under igniter firing, which is inductive, the capacitive reactance presented by capacitor 80 enables compensation of these inductive reactances resulting in an increased primary current. The resonance principle cannot be used in its entirety to explain the phenomena involving the capacitor's compensation function, since resonance generally involves a single frequency and, consequently unlike here, unique reactance value, and in this system multiple frequencies are generated by power source 70 which involve a like number of different reactances. In any event, such capacitor 80 is selected by trying various values of capacitors until the primary current is at a maximum. Such primary current may be conveniently measured and observed by using a one-ohm high power resistor in the primary winding circuit, say between junction 21 and the collector of Q2, and measuring the voltage across such resistor by means of an accurately calibrated high frequency oscilloscope. Typical capacitor values will be in the order of between 0.2 to 1.0 microfarads.

Ignition transformer 90 was selected to have a turns ratio of 100, somewhat higher than stock automobile transformer turns ratios, since this will provide a greater voltage induced in secondary 92 and transferred to either an igniter or to a switching distributor by means of high voltage cable 94.

A high power, high voltage rated and high current rated power transistor Q2 is used as and inhibit control device. Such transistor may typically be selected from the group of type 2N6251 made by RCA, type 2N6547 made by Motorola, type FT 359 made by Fairchild, or any of a series of Darlington type transistors made by Motorola of the MJ series such as MJ 10009. It is important not only to select a transistor for this purpose which will have a high collector current rating, but such transistor should also be able to withstand the high collector to emitter voltages. Bias resistor 40 of transistor switch Q2 is selected of sufficient ohmic value to limit the base current to a safe level within the rating limits of that transistor, and a bias resistor value is used that permits just enough base current to flow so as to enable Q2 to perform its switching function rapidly. Providing too much base current in Q2 by having too low an homic value for resistor 40 will slow down switching time of Q2 from its ON to its OFF state, and will tend to defeat the major purpose and use of switch Q2.

In a high power system such as illustrated, which approaches 10 kilowatts of instantaneous power, separation of firing waveforms normally are not possible by virtue of the fact that energy generated by source 70 and residual in its transformer windings, will tend to cause the primary current to continue to flow after the Q's of circuit 70 are biased to their OFF states. Consequently, switch Q2 acts to assure rapid deprivation of energy feed to transformer 90 by inhibiting such residual energy from transferring to such transformer at the end of each igniter firing cycle. Such is accomplished in inhibiting the primary current flow at that time by interrupting such current flow in the output circuit by means of rapidly turning off Q2 at the same time as the Q's of source 70 are turned off. The penalty for not having such switch as Q2 in a high power unit is that pre-ignition firing will occur since the next-in-sequence igniter would be prematurely ignited by virtue of the current and voltage waveforms being continued beyond the required firing period.

A cursory examination of the Q2 circuit, would appear to indicate Q2 inoperability in view of no hard wire collector connection to a DC power source. However, as was previously mentioned, Q2 is enabled, that is the equivalent of such DC power is provided to the collector by the positive potential going peak excursions of the waveforms provided by AC source 70. The rate of such excursions, say in the order of between 2.5 and 10 kilocycles per second, though a 5 kilocycle per second rate was actually used, serves to maintain Q2 in its conductive mode throughout each and every igniter fire cycle.

A further benefit may be derived when a Darlington circuit type transistor such as an MJ 10009, MJ10001 or and MJ 10005 by Motorola is chosen as the Q2 transistor. Such Darlington circuit is inherently a current amplifier, so that the current produced by the firing gate to trigger the base of Q2 to its ON state is amplified by Q2 and adds additional current to the current quantity in the primary winding. It should be noted that since the primary current increases, the voltage across primary 91 will be increased by virtue of the increased current flow.

Another feature of the inventive system, including of course the variations of such system as discussed below in conjunction with the other system figures herein, is the quiescent state of power source 70 for about 25% of the system on-time. Inasmuch as Darlington circuits are used for the Q's, high AC currents circulate in their collector circuits in the ON modes of such Q's. Such high currents will contribute to high induced voltages in winding 72, and would normally require large heat sinks to dissipate the heat generated thereby. Since in this power generator, each of the Q's is in its ON state only half the time of each cyclic excursion of the AC current produced therein, and since each igniter firing period is less than one-half its non-firing period in time duration, triggering bias winding 73 in order to turn the Q's on and off, will permit the transistors to be maintained at relatively low operating temperatures because each of the Q's will in effect have a duty cycle of less than 25%. Further, switching such power source 70 to its ON mode will create a transient voltage at the beginning of each firing cycle which will be greater in amplitude than the voltage normally deliverable by such source 70, absent this type of switching.

The foregoing discussion related to the case where Q2 was used as the energy inhibit switch. Such foregoing discussion assumed that when Q2 was so used, Q3, Q4, Q5 and Q7 were not in the FIG. 1 circuit. Accordingly, with Q2 performing the energy inhibit function, Q3, Q4, Q5 and Q7 are removed from their sockets and electrically by-passed. Q3 is by-passed by electrically connecting terminals 19 and 22. Q4 is by-passed by connecting its socket collector to ground. Q5 is by-passed by connecting its socket collector terminal to terminal 19. Q7 is by-passed by connecting terminal 19 to the emitter terminal of its socket. The base circuits of the foregoing by-passed transistor switches under these circumstances will have no affect since they will be electrically open circuited. It will be understood, without further statements, that only one of the group of Q2, Q3, Q4, Q5 or Q7 switches will be in circuit at any one time, all others will be by-passed as stated in the above switch by-passing examples, and when Q2 is by-passed terminal 21 is connected to ground, with Q2 removed from its socket.

With this in mind, it can be seen that when Q3 is operative, all other transistors performing the energy inhibit function will be by-passed, and in such case base current to Q3 will be provided by virtue of electrical connection 13–14 to base current limiting resistor 75. The collector of Q3 will be connected to terminal 19, which under by-pass condition of Q5 will be electrically at terminal 20, the positive DC potential feed from battery 9 of the system. The emitter of Q3 will be connected to center tap 22 of winding 71. Operationally, Q3 will be keyed on and off for each ignition cycle, as discussed for the case of Q2 above by means of logic circuit 30, so as to turn off DC power to the collectors of the Q's and thereby inhibit energy from being transferred to transformer 90 at the end of such ignition firing cycle.

When Q4 is used as the energy inhibit switch, then Q2, Q3, Q5 and Q7 are by-passed. In such case, the collector of Q4 is connected to the emitters of the Q's and the emitter of Q4 is at ground potential, and the base of Q4 is connected through its bias resistor 76 to cable 15–16 which is at the same potential as terminal 41 of Q1. Such connection of Q4, switches the emitters of the Q's on and off by interrupting current flow in the emitter circuit of such Q's.

When Q5 is used as the energy inhibit switch, then Q2, Q3, Q4 and Q7 are by-passed. In such case, the collector of Q5 receives its positive DC potential from terminal 20, the emitter of Q5 by virtue of by-pass of Q7 will feed one end of winding 72, and the base of Q5 is connected through bias resistor 78 to cable 17–18 which is at the same potential as terminal 41 of Q1. Such connection of Q5 switches off any residual energy stored in winding 72 from being transferred to the ignition transformer after the ignition firing cycle is terminated, as well as disconnecting DC power from source 70 at that time.

When Q7 is used as the energy inhibit switch, then Q2, Q3, Q4 and Q5 are by-passed. In such case, the collector of Q7 will be at the potential of terminal 20 which the DC positive potential provided by battery 9, the emitter of Q7 will be connected to winding 72, and the base of Q7 will be connected through its bias resistor 79 to cable 23–24 which is at the same potential as terminal 41 of Q1. Such connection of Q7 will prevent any residual energy stored in winding 72 from being transferred to the ignition transformer after the ignition firing cycle is terminated.

The use of Q7 as the energy inhibit switch as well as the use of Q5, provides the lowest collector to emitter voltages, but have the detriment of not having the ignition transformer primary winding 91 in their collector circuits, with no attendant advantage of current amplification, as compared with Q2 switch circuit.

The use of Q3 or Q4 for the energy inhibit purpose is quite effective, but use of either such switch in these particular parts of the circuit serves to drop the DC voltage fed to the primary circuit of the AC power source with attendant drop in power output from such AC source.

Figure 2:
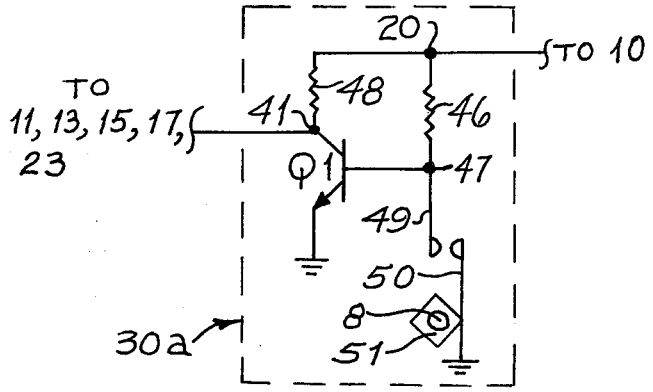
FIG. 2 is a schematic of the same system illustrated in FIG. 1, but having cam actuated contactors as the trigger means or timer.

Referring to FIG. 2, the system illustrated is identical to the systems as discussed in connection with FIG. 1, except that circuit 30 is replaced by circuit **30*a***.

Circuit **30*a* used a conventional cam actuated pair of contactors wherein engine distributor shaft 8 drives cam 51, the high portions of which cause the cessation of cooperation between contactors 49 and 50. When the high portions of cam 51 are not in cooperation with contactor 50, such contactor will cooperate with contactor 49. Contactor 49 is connected to junction 47, which junction is also the base of transistor switch Q1, electrically speaking, and Q1 is the same switch as used in FIG. 1. Resistor 46 provides a DC positive potential to junction 47 when contactor pair 49–50 are open, and thus enables base current in Q1 to flow. When contactor pair 49–50 are closed, junction 47 is at ground potential. The collector of Q1 is connected through its resistor 48 to the DC positive feed at terminal 20, fed by battery 9 by virtue of its connection to junction 10. The emitter of Q1 is at ground potential. Thus terminal 41 provides the same gate thereat as in FIG. 1 and supplies switching potentials to terminals 11, 13, 15, 17 and 23. The following table summarizes the switching logic of circuit 30*a***.

| Contactor Pair 49–50 | Potential at Junction 47 | State of Q1 | Potential at Junction 41 | State of Q's | State of Q2 |
|---|---|---|---|---|---|
| open | positive | ON | ground | OFF | ON |
| closed | ground | OFF | positive | ON | ON |

Hence, when cam 51 causes contactors 49–50 to cooperate, the base Q1 is biased at ground potential, collector current does not flow in Q1 and Q1 does not conduct. When cam 51 causes contactor pair 49–50 to open, ground is removed from junction 47 and base current flows in Q1 and Q1 conducts thereby providing ground potential at junction 41. Such ground potential biases Q2 and the Q's to their OFF states. When Q1 does not conduct, junction 41 will be at a positive potential thereby causing Q2 and the Q's to be turned ON due to the base currents flowing in Q2 and the Q's.

Thus it can be seen that the logic circuit and the timer as herein illustrated may be utilized in the circuit of FIG. 1 instead of the timer shown therein, and yet maintain all the same functions and operations of the system as heretofore discussed. The functions performed by Q2 may be performed by either Q3, Q4, Q5 or Q7 as above described, but in conjunction with circuit **30*a* instead of circuit 30**.

Figure 3:
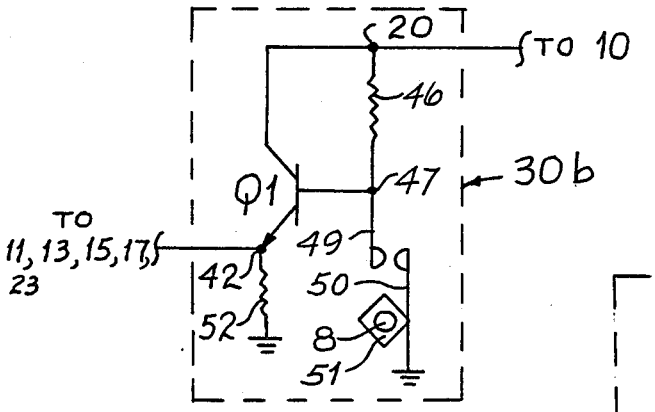
FIG. 3 is a schematic of the same system as in FIG. 1 except that the cam actuated contactors therein are connected in a different manner than in FIG. 2.

Referring to FIG. 3, the system illustrated is identical to the system as discussed in connection with FIG. 1, except for circuit 30 being replaced by circuit **30*b***.

Circuit **30*b* is identical in structure and function to logic circuit 30*a* described in connection with FIG. 2, except that the collector is connected directly to the positive DC source and a resistor 52 is connected between the emitter of Q1 at junction 42 and ground. Thus junctions 11, 13, 15, 17 and 23 are connected to junction 42 in FIG. 3 as compared to being connected to junction 41 of FIGS. 1 or 2. The FIG. 3 structure will function in the same manner as FIG. 2** structure, except the logic thereof will be as follows:

| Contactor Pair 49–50 | Potential at Junction 47 | State of Q1 | Potential at Junction 42 | State State of Q's | State State of Q2 |
|---|---|---|---|---|---|
| closed | ground | OFF | ground | OFF | OFF |
| open | positive | ON | positive | ON | ON |

The discussion in connection with the use of Q3, Q4, Q5 or Q7 as the energy inhibit switch, instead of Q2, as discussed in conjunction with FIG. 1, applies here when circuit **30*b* is used in lieu of circuit 30**.

Figure 4:
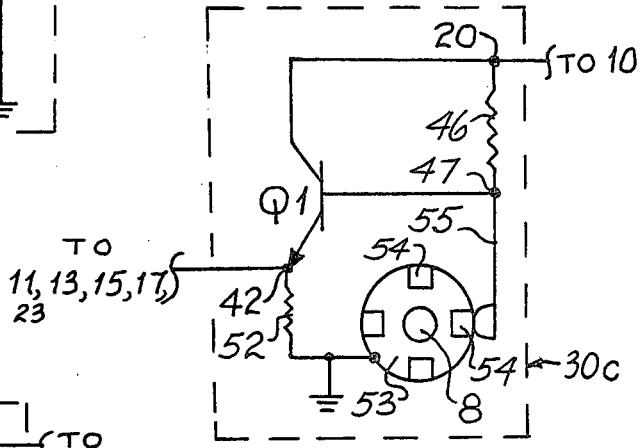
FIG. 4 is a schematic of the same system illustrated in FIG. 1 but having a driven wheel and contactor assembly acting as the trigger means or timer.

Referring to FIG. 4, it can be seen that circuit **30*c* therein is functionally the same as circuit 30*b*, except that instead of cam actuated contactors a disk 53 driven by shaft 8 is used in cooperation with a contactor 55 which cooperates with the disk periphery, and which contactor is connected to junction 47. Shaft 8 being at ground potential will electrically ground the metallic portions of disk 53. Disk 53 has a plural number of electrically insulative members 54 regularly spaced at the periphery of the disk within the disk confines. The number of members 54 will be equal to the number of igniter circuits as provided by a high voltage distributor, not shown, but conventional. Here, four igniter circuits and corresponding four igniters, one for each of the four engine cylinders is assumed by virtue of illustrating four insulating members 54. When an insulative member 54 is in cooperation with contactor 55, the base of Q1 being at the same potential as junction 47, is biased with a positive DC potential and Q1 conducts thereby providing a positive potential at its emitter at junction point 42, consequently providing such positive bias to junctions 11, 13, 15, 17 and 23, thereby turning on Q2 and the Q's to perform the functions as hereinabove described in connection with FIGS. 1 or 3. When contactor 55 is in cooperation with the metallic or conductive portions of disk 53, junction 47 is at ground potential, Q1 does not conduct, and junctions 11, 13, 15, 17 and 23 are at ground potential, thereby turning off Q2 and the Q's, or in the case of Q3, Q4, Q5 or Q7 turning off those transistors. The following logic table is applicable to show the logic of FIG. 4** configuration:

| Contactor 55 in Cooperation With | Potential at Junction 47 | State of Q1 | Potential at Junction 42 | State of Q's | State of Q2 |
|---|---|---|---|---|---|
| metallic portion of disk 53 | ground | OFF | ground | OFF | OFF |
| member 54 | positive | ON | positive | ON | ON |

The discussion in connection with the use of Q3, Q4, Q5 or Q7 as the energy inhibit switch, instead of Q2, as stated in connection with FIG. 1 discussion, applies here when circuit 30*c* is used in lieu of circuit 30.

Figure 5:
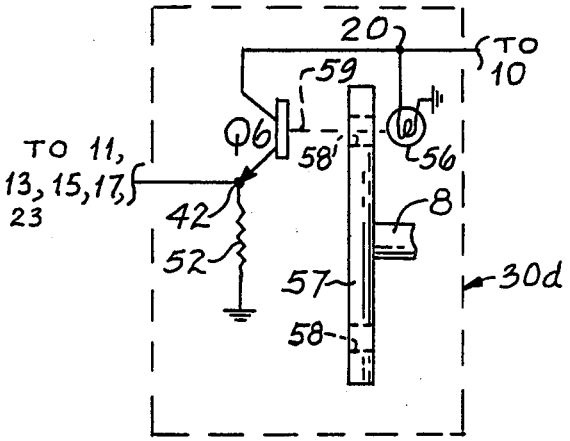
FIG. 5 is a schematic of the same system illustrated in FIG. 1 but having an optical trigger means or timer.

Referring to FIG. 5, the system illustrated is identical to the system as discussed in connection with FIG. 1, except that trigger circuit 30 is replaced by an optical trigger and logic circuit 30*d*.

Circuit 30*d* comprises a disk 57 driven by distributor shaft 8. Disk 57 has apertures 58 regularly spaced in the disk at the periphery thereof. Powered illumination means 56 is provided at one face of disk 57 for optically intermittently illuminating the base of an optically sensitive transistor Q6 by means of a light beam 59 impinging on the base of Q6 and thereby causing the emitter of Q6 at junction 42 to rise to a positive DC potential by virtue of collector current flowing in Q6. When light beam 59 is blocked by the opaque portion of disk 57, Q6 is off and no collector current flows in Q6, and consequently the potential at either end of resistor 52 is the same, namely ground potential. Hence, when Q6 is in its OFF state, junctions 11, 13, 15, 17 and 23 will be at ground potential, maintaining Q2 and the Q's in their OFF states. On the other hand when Q6 is in its ON state, junctions 11, 13, 15, 17 and 23 will be at positive DC potential maintaining Q2 in its ON state and the Q's in their oscillatory modes. The following table shows the logic of the FIG. 5 configuration:

| Light Beam 59 | State of Q6 | Potential at Junction 42 | State of Q's | State of Q2 |
|---|---|---|---|---|
| blocked by disk 57 | OFF | ground | OFF | OFF |
| passes through aperture 58 | ON | positive | ON | ON |

The discussion in connection with the use of Q3, Q4, Q5 or Q7 as the energy inhibit switch instead of Q2 as discussed in connection with FIG. 1, applies here when circuit 30*d* is used in lieu of circuit 30.

Figure 6:
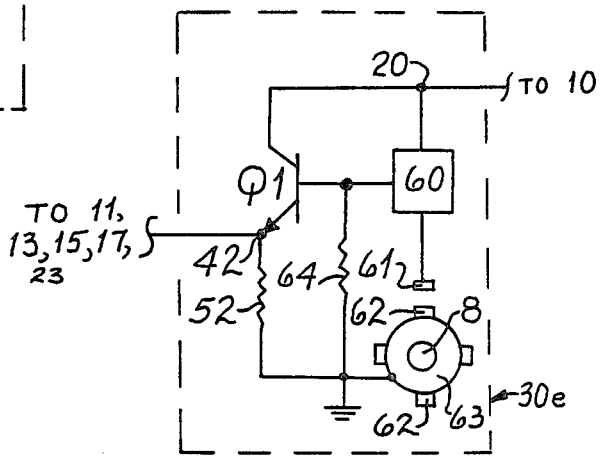
FIG. 6 is a schematic of the same system as illustrated in FIG. 1 but having a modulated oscillator as the trigger means or timer.

Referring to FIG. 6, the system illustrated is identical to the system as discussed in connection with FIG. 1, except that circuit 30 is replaced by circuit 30*e*.

Circuit 30*e* employs an angular modulated oscillator wherein oscillator 60 is modulated by virtue of a variable capacitor being driven by distributor shaft 8. Such capacitor comprises a rotatable plate 63 having protrusions 62 regularly spaced at the periphery of plate 63, and having a single fixed plate 61 connected to oscillator 60. Plate 63 is at ground potential since it is attached to shaft 8 which is grounded. Oscillator 60 provides a positive going signal output imposed upon the base of Q1 whenever a protrusion 62 is driven past fixed plate 61. More details concerning this modulation method is available in U.S. Pat. No. 4,122,815 issued Oct. 31, 1978 which was incorporated by reference herein.

Logic circuit 30*e* has a bias resistor 64 connected between the base of transistor Q1 and ground, so as to maintain the base at ground potential until such time as a positive signal from oscillator 60 drives the base sufficiently positive to cause base current to flow and hence to cause collector current to flow and Q1 to conduct.

The emitter of Q1 has resistor 52 connected between it and ground, so that when the base of Q1 is at ground potential and no collector current flows, the emitter of Q1 and junctions 42, 11, 13, 15, 17 and 23 will be at ground potential thereby maintaining Q2 and the Q's in their OFF states. When a positive going signal from oscillator 60 appears at the base of Q1 due to the oscillator being angularly modulated, the base of Q1 will be driven positive and base current will flow to cause Q1 to switch to its ON state, thereby raising the emitter of Q1 at junction 42, as well as raising junctions 11, 13, 15, 17 and 23 to a positive DC potential and causing Q2 to be switched to its ON state and the Q's to oscillate. The following table expresses the logic performed by the FIG. 6 configuration:

| Oscillator 60 | Potential at Base of Q1 | State of Q1 | Potential at Junction 42 | State of Q's | State of Q2 |
|---|---|---|---|---|---|
| not modulated | ground | OFF | ground | OFF | OFF |
| angularly modulated | positive | ON | positive | ON | ON |

The discussion in connection with the use of Q3, Q4, Q5 or Q7 as the energy inhibit switch as discussed in connection with FIG. 1, instead of Q2, applies here when circuit 30*e* is used in lieu of circuit 30.

Figure 7:
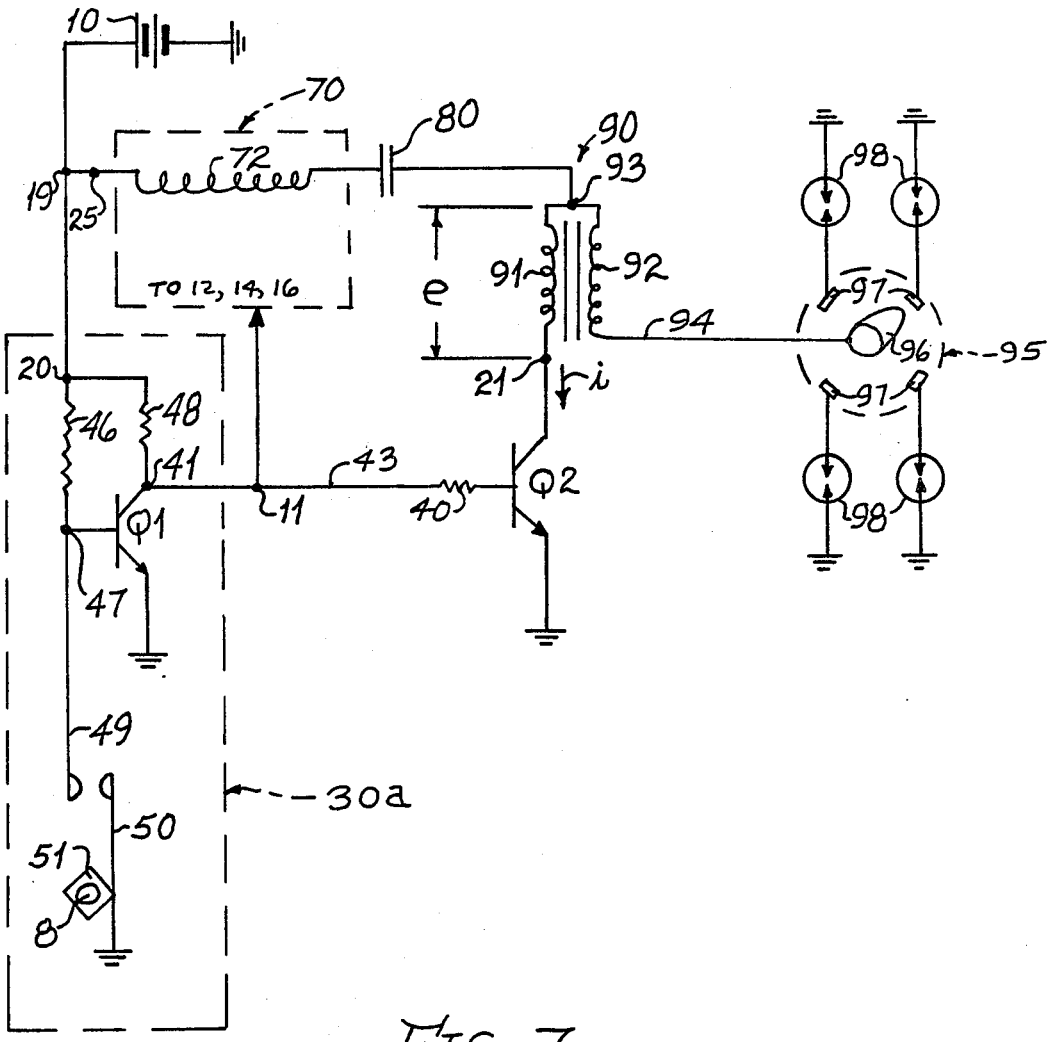
FIG. 7 is a schematic of an equivalent circuit which represents any of FIGS. 1, 2, 3, 4, 5 or 6, for the purpose making voltage and current measurements by means of an oscilloscope and for enabling the photographing of waveforms so made.

Referring to FIG. 7, the equivalent circuit for each of the configurations of FIGS. 1, 2, 3, 4, 5 or 6, may be represented by such FIG. 7, set up in the laboratory so as to enable actual waveform photographs to be made, and to enable actual measurements to be made of the ignition transformer primary voltage and current.

It is obvious from FIG. 7 that such figure uses the timer and logic circuit for the system of FIG. 2. However, the measurements of voltage e and current i, are equally applicable to the other configurations.

In this test set up, a conventional high voltage distributor 95 was driven by an electric motor driving shaft 8, thus driving cam 51 and distributor rotor 96. Igniters 98 were connected to the stationary members 97 of distributor 95.

The table below, shows peak-to-peak values of voltage e across primary winding 91 and peak-to-peak values of current i through such primary winding, as measured by a calibrated Hewlett-Packard 50 megacycle oscilloscope. The oscilloscopic patterns of the current were made by inserting a high power one-ohm resistor in series with the primary winding and connecting the oscilloscope input leads thereacross. By Ohm's law, the voltage measured will be the current, since such voltage is divided by one-ohm. This table shows the voltages and currents under conditions when both Darlington type transistors and when non-Darlington type transistors are used in the Q2 switch, or alternatively in the Q3, Q4, Q5 or Q7 switches. FIG. 7 configuration was used for these laboratory tests, wherein a conventional distributor was connected to the secondary winding 92 and in turn the distributor was connected to a number of igniters. Such distributor was driven by an electric motor at a speed simulating medium distributor rotation speed in an automobile. The following table shows the results of measurements made:

| Parameter | Non-Darlington Q2, 2N6251 or 2N6547 | Darlington Q2, MJ 10005 - Motorola |
|---|---|---|
| i (peak-to-peak) | 8.33 amperes | 12.5 amperes |
| e (peak-to-peak) | 1200 volts | 1330 volts |
| P = ie | 9996 watts | 16,625 watts |
| $E_{primary}$ | 2.08 watt-seconds | 3.46 watt-seconds |
| $E_{igniter}$ | 1.87 watt-seconds | 3.12 watt-seconds |
| $N = \frac{E_{igniter}}{E_{Kettering}}$ | 200 | 333 |

$\epsilon_{primary}$, the energy in the ignition transformer primary winding was computed using a firing period of t=0.833 milliseconds, the firing period for an igniter in an 8 cylinder engine driven at 6000 revolutions per minute, and including the duty cycle for the voltage wave and current wave provided by the AC source of T=0.5 each, therefore $\epsilon_{primary}=PtT^2$.

$\epsilon_{igniter}$ is the energy in the secondary winding of the ignition transformer and hence the igniter firing energy, which is the energy in the primary winding multiplied by the ignition transformer transfer efficiency $\eta=0.9$, therefore $\epsilon_{igniter}=\eta\epsilon_{primary}$.

Here, the difference between the use of Darlington Q2 switch and a non-Darlington switch becomes evident in terms of the increased voltage and current and consequently in terms of instantaneous power and energy levels.

However, when Q2 or any of these other like switches are not in circuit, or by-passed, the results obtained are as indicated in the above table. Such results indicate that there is residual energy stored in the coupling transformer of the AC power source and transfer of such residual energy to the ignition transformer primary after the timer of the system and its logic circuit in operation had biased the Q's of the AC source to their non-conducting states. Such residual energy is cut off by Q2 control, or the other like mentioned switches, simultaneously with deactivation of the AC source, as hereinabove explained, the Q2 switch serving to inhibit current flowing, due to residual energy in the coupling transformer, at the end of each igniter firing period.

It also becomes evident from the foregoing, that Q2 utilized to control igniter firing energy, also functions to increase the energy level of the system by its switching and by amplifying the firing gate current, as such amplified current is added to the current provided by the AC power source.

A comparison with a conventional Kettering system, utilizing an igniter of conventional type with its spark gap setting in accordance with automotive manufacturer's specification, may be made with the performance of an igniter in the inventive system. The conventional Kettering system was set up in the laboratory with a driven conventional distributor similar to the laboratory set up for the inventive system as discussed above. The difference in performance between the Kettering system, as photographed, with the inventive system in terms of arc area coverage and energy delivered to ignite the engine fuel, is rather startling, and self evident from the results obtained.

What is claimed is:

1. In an alternating current power source having solid state active devices and a transformer having an output winding for feeding an impedance load, comprising the combination of:

a capacitor connected in series with the output winding and the load;

logic means coupled to the transformer for activating said power source during a first mode of its operation and for deactivating said power source during a second mode of its operation; and control means, coupled to said transformer and triggered by the logic means, for inhibiting energy residual in said transformer from being transferred therefrom during said second mode.

2. The invention as stated in claim 1, wherein said power source is a rectangular wave generator.

3. The invention as stated in claim 1, wherein said logic means intermittently biases inputs of said solid state active devices.

4. The invention as stated in claim 1, wherein said logic means comprises an intermittently triggered electronic switch.

5. The invention as stated in claim 1, wherein said control means constitutes electronic means serially electrically coupled to said output winding for inhibiting energy residual in said output winding from being transferred to said load during said second mode.

6. The invention as stated in claim 1, wherein said control means constitutes electronic means connected to said power source for providing DC power to said power source during said first mode and for turning off said DC power during said second mode.

7. The invention as stated in claim 1, wherein said solid state devices have collectors and wherein said control means constitutes electronic means coupled through said transformer to said collectors for providing DC power to said collectors during said first mode and for turning off said DC power during said second mode.

8. The invention as stated in claim 1, wherein said solid state devices have emitters and wherein said control means constitutes electronic means connected to said emitters for providing DC power to said emitters during said first mode and for turning off said DC power during said second mode.

9. The invention as stated in claim 1, including trigger means, coupled to said logic means, for intermittently activating said logic means.

10. The invention as stated in claim 1, wherein said impedance load comprises an ignition transformer having a primary winding, said primary winding being connected in series with said output winding and capacitor, said control means being an electronic switch connected in series with said output winding.

11. The invention as stated in claim 5, including a DC supply, said electronic means being connected between said DC supply and said output winding.

12. The invention as stated in claim 5, wherein said impedance load comprises an ignition transformer having a primary winding and wherein said electronic means is connected in series with said primary winding.

13. The invention as stated in claim 9, wherein said trigger means comprises a magnetic pulse timer.

14. The invention as stated in claim 9, wherein said trigger means comprises cam actuated contactors.

15. The invention as stated in claim 9, wherein said trigger means comprises an electrically conductive disk having a plural number of electrically insulative members regularly spaced at the periphery of the disk within the confines of said disk, and a contactor coupled to the logic means and in cooperating with said periphery.

16. The invention as stated in claim 9, wherein said trigger means comprises a disk having apertures regularly spaced in the disk at the periphery of said disk and illumination means at one face of said disk for optically illuminating said logic means through said apertures.

17. The invention as stated in claim 9, wherein said trigger means comprises a modulated oscillator coupled to said logic means.

* * * * *